United States Patent [19]

Banks et al.

[11] Patent Number: 5,054,775

[45] Date of Patent: Oct. 8, 1991

[54] GAME RELATING TO PERSONAL RELATIONSHIPS

[76] Inventors: Silvia Banks; Robert C. Banks, both of 4406 Milburn Dr., Colorado Springs, Colo. 80906

[21] Appl. No.: 533,013

[22] Filed: Jun. 4, 1990

[51] Int. Cl.[5] ..... A63F 9/00

[52] U.S. Cl. ..... 273/431

[58] Field of Search ..... 273/1 R, 1 G, 292, 242, 273/243; 434/236

[56] References Cited

U.S. PATENT DOCUMENTS

| | | | |
|---|---|---|---|
| 3,734,510 | 5/1973 | Breslow | 273/292 |
| 3,777,413 | 12/1973 | Zaccheo | 273/1 R X |
| 4,741,539 | 5/1988 | Sutton et al. | 273/275 |

*Primary Examiner*—Paul E. Shapiro
*Attorney, Agent, or Firm*—Leon Gilden

[57] ABSTRACT

A board game including a plurality of stacks of cards. The first stack of cards defining questions cards relating to personal relationships between individuals, wherein a second category of cards is defined by four different categories including "true", "false", "pass", and "challenge". A first player selects a questions card and an associated category card, whereupon response to the question is dependent upon the category chosen. A correct response relative to the category effects a rolling of a plurality of dice by another player to determine a point total for the player correctly responding to the question and the associated category. The player responding to the selected question continues until an incorrect response is solicited. Subsequent to the response to the question and associated category, a second stack of cards for the answered question and the utilized category card is effected.

2 Claims, 4 Drawing Sheets

GAME RELATING TO PERSONAL RELATIONSHIPS

BACKGROUND OF THE INVENTION

1. Field of the Invention

The field of invention relates to category games, and more particularly pertains to a new and improved game relating to personal relationships wherein the same randomly associates relationship questions to a plurality of categories to effect an appropriate response.

2. Description of the Prior Art

Various personality trait and relationship games have been utilized in the prior art, but have heretofore been of a relatively complex and elaborate organization to discourage their frequent and continued use. The instant invention attempts to overcome deficiencies of the prior art by setting forth a board game wherein the same presents a convenient association of questions and a random association of such questions to one of a plurality of categories.

Examples of prior art games of this class may be found in U.S. Pat. No. 4,741,539 to Sutton, et al. wherein a board game relating to personality traits is set forth, with a playing area being divided into six triangular areas, each representing a trait of the personality utilizing cards and questions answered by players to determine progress during the game, and tokens directed through the board during play of the game.

U.S. Pat. No. 4,736,954 to Haney, et al. sets forth a question and answer game to direct movement about a board surface.

U.S. Pat. No. 4,674,752 to Brothers sets forth a trivia board game utilizing questions and answers to effect relationship between the board and the questions and answers of the game.

U.S. Pat. No. 4,657,248 to Benaim wherein a question and answer game is related to a plurality of flip-flop plates associated with the game.

U.S. Pat. No. 4,856,780 to Begley sets forth a sports trivia board game utilizing questions and answers relating to movement of players about the board of the game.

As such, it may be appreciated that there continues to be a need for a new and improved game relating to personal relationships providing ease of use as well as well as effectiveness in organization to permit a plurality of players to test each other's skill in response to questions and associated categories of the game and as such, the present invention substantially fulfills this need.

SUMMARY OF THE INVENTION

In view of the foregoing disadvantages inherent in the known types of question and answer games now present in the prior art, the present invention provides a game relating to personal relationships utilizing a series of questions within a category relating to personal relationships and associating these questions with a plurality of categories to effect response from an individual. As such, the general purpose of the present invention, which will be described subsequently in greater detail, is to provide a new and improved game relating to personal relationships which has all the advantages of the prior art questions and answer games and none of the disadvantages.

To attain this, the present invention provides a board game including a plurality of stacks of cards. The first stack of cards defining question cards relating to personal relationships between individuals, wherein a second category of cards is defined by four different categories including "true", "false", "pass", and "challenge". A first player selects a question card and an associated category card, whereupon response to the question is dependent upon the category chosen. A correct response relative to the category effects a rolling of a plurality of dice by another player to determine a point total for the player correctly responding to the question and the associated category. The player responding to the selected question continues until an incorrect response is solicited. Subsequent to the response to the question and associated category, a second stack of cards for the answered question and the utilized category card is effected.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved game relating to personal relationships which has all the advantages of the prior art questions and answer games and none of the disadvantages.

It is another object of the present invention to provide a new and improved game relating to personal relationships which may be easily and efficiently manufactured and marketed.

It is a further object of the present invention to provide a new and improved game relating to personal relationships which is of a durable and reliable construction.

An even further object of the present invention is to provide a new and improved game relating to personal relationships which is susceptible of a low cost of manufacture with regard to both materials and labor, and which accordingly is then susceptible of low prices of sale to the consuming public, thereby making such games relating to personal relationships economically available to the buying public.

Still yet another object of the present invention is to provide a new and improved game relating to personal relationships which provides in the apparatuses and methods of the prior art some of the advantages thereof, while simultaneously overcoming some of the disadvantages normally associated therewith.

Still another object of the present invention is to provide a new and improved game relating to personal relationships wherein the same permits ease of use in effecting questions and response between a plurality of players to effect a point total determining a winner of the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
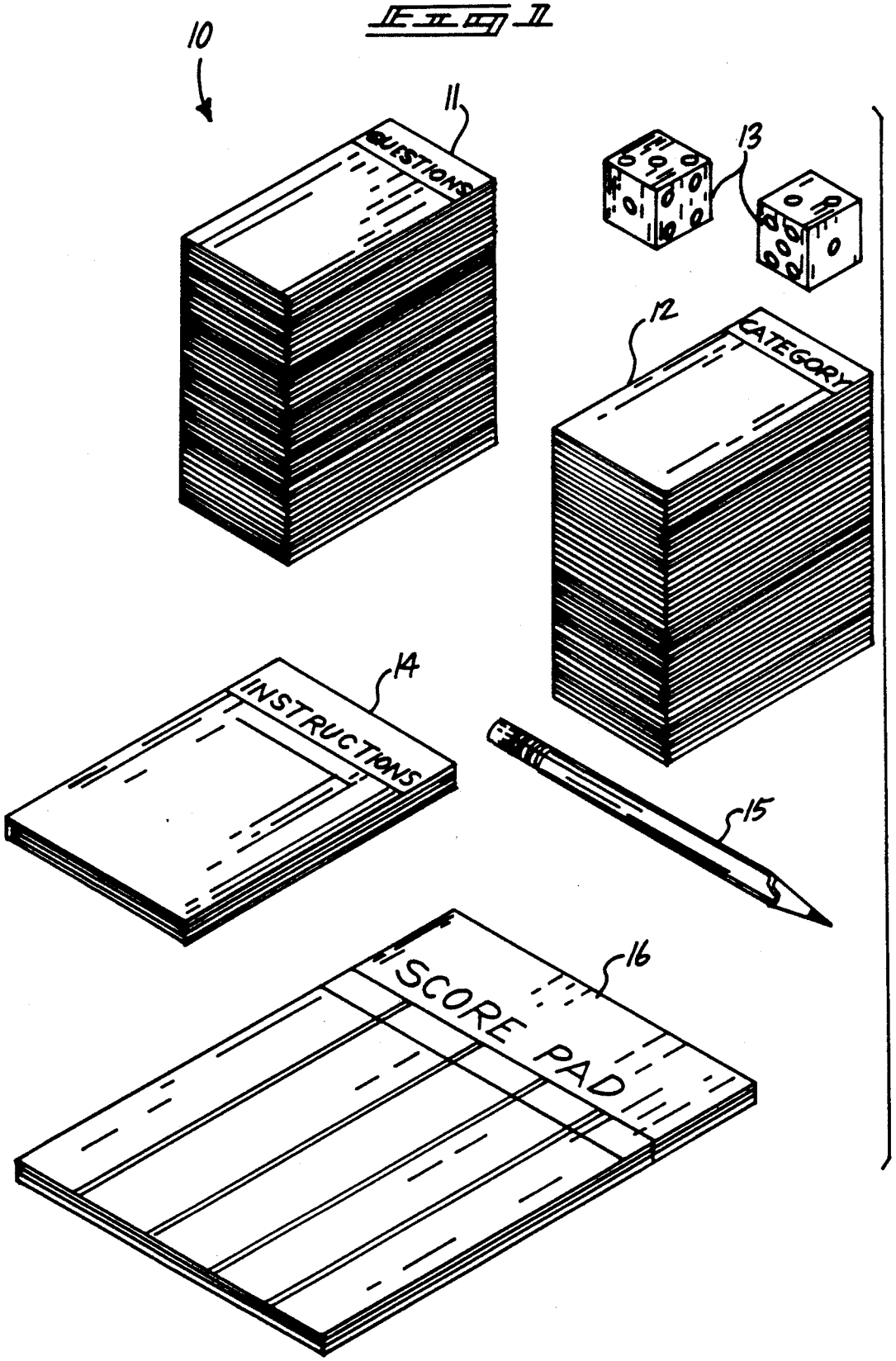
FIG. 1 is an isometric illustration of the various components of the instant invention.

With reference now to the drawings, and in particular to FIGS. 1 to 7 thereof, a new and improved game relating to personal relationships embodying the principles and concepts of the present invention and generally designated by the reference numeral 10 will be described.

Figure 2:
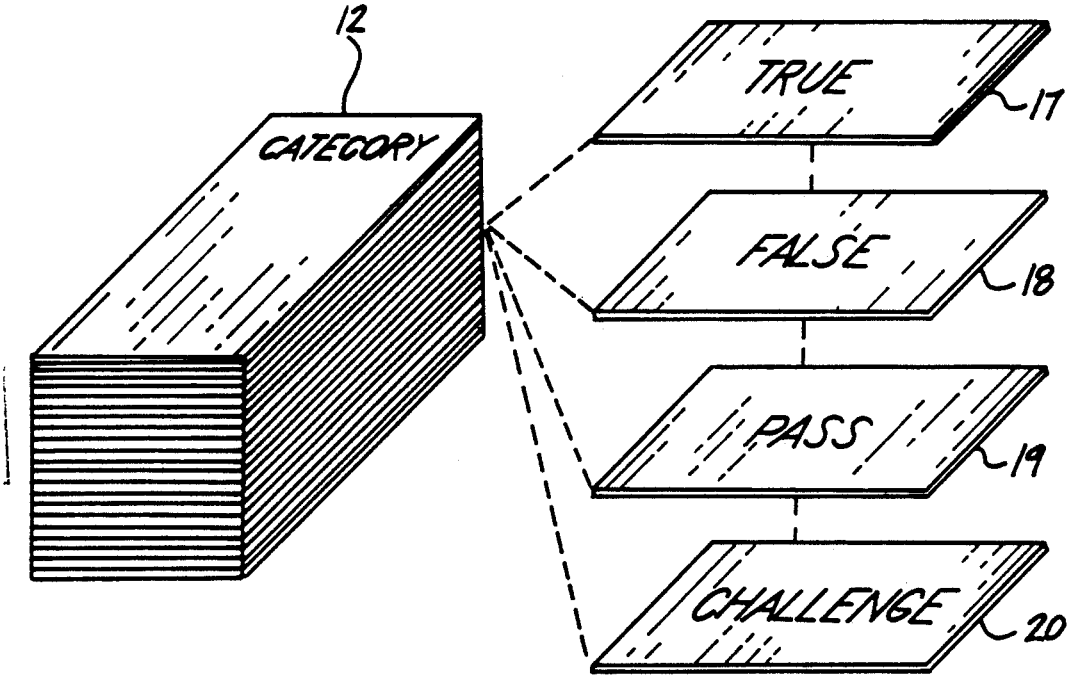
FIG. 2 is an isometric illustration of the category card stack utilized by the instant invention.
Figure 3:
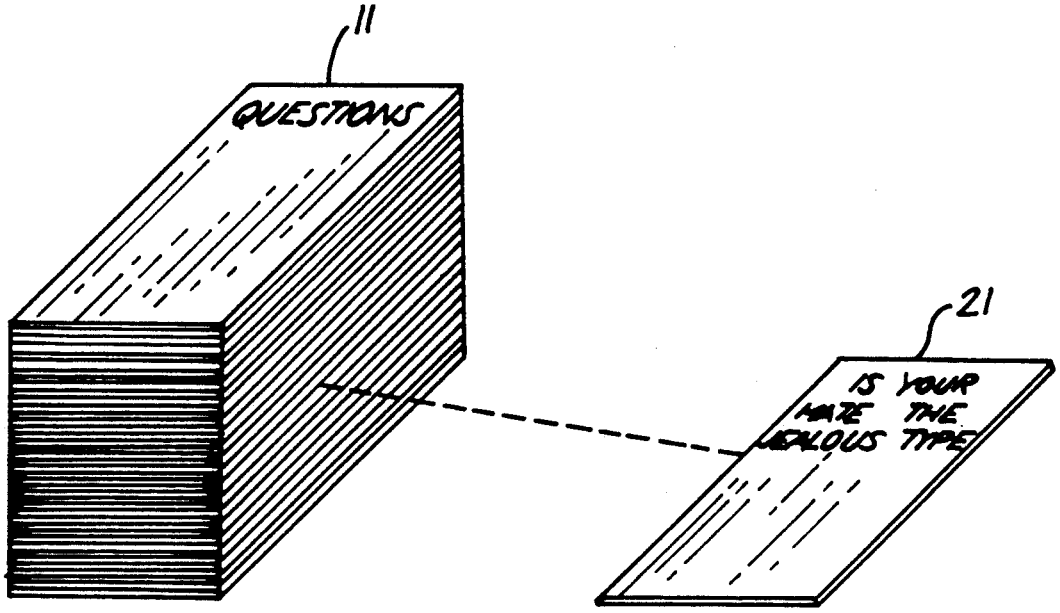
FIG. 3 is an isometric illustration of the question card stack utilized by the instant invention, and a typical question associated therewith.
Figure 4:
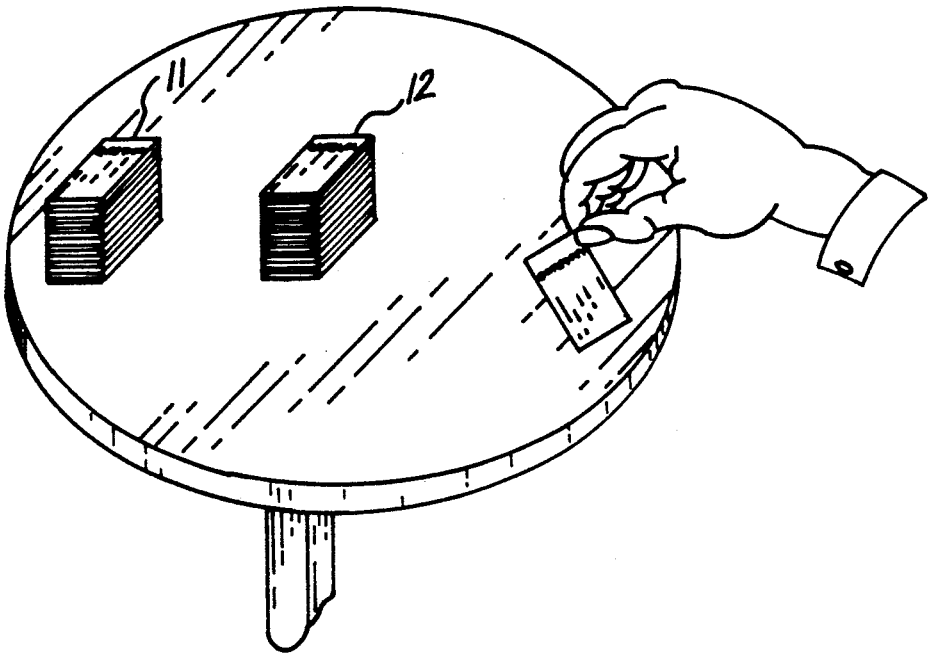
FIG. 4 is an isometric illustration of an initial stage and play of the instant invention.
Figure 5:
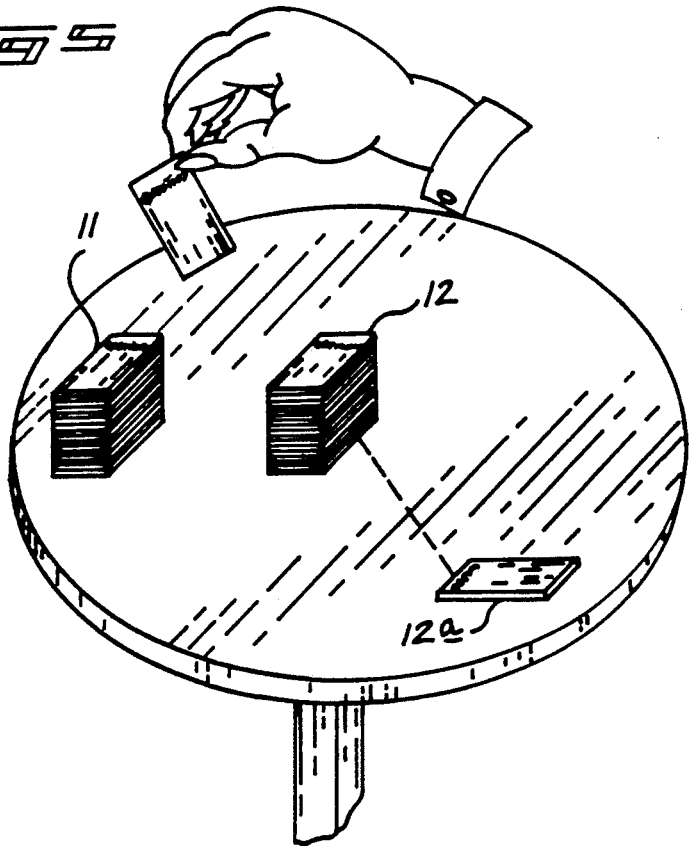
FIG. 5 is an isometric illustration of a subsequent step in the play of the instant invention.
Figure 6:
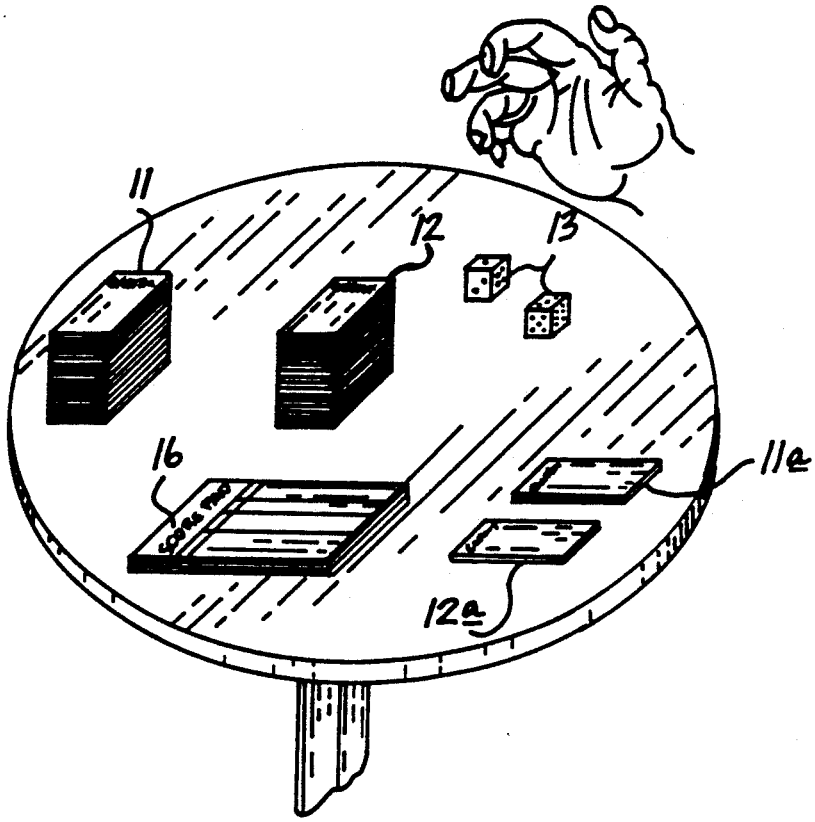
FIG. 6 is an isometric illustration of a further step in the play of the instant invention.
Figure 7:
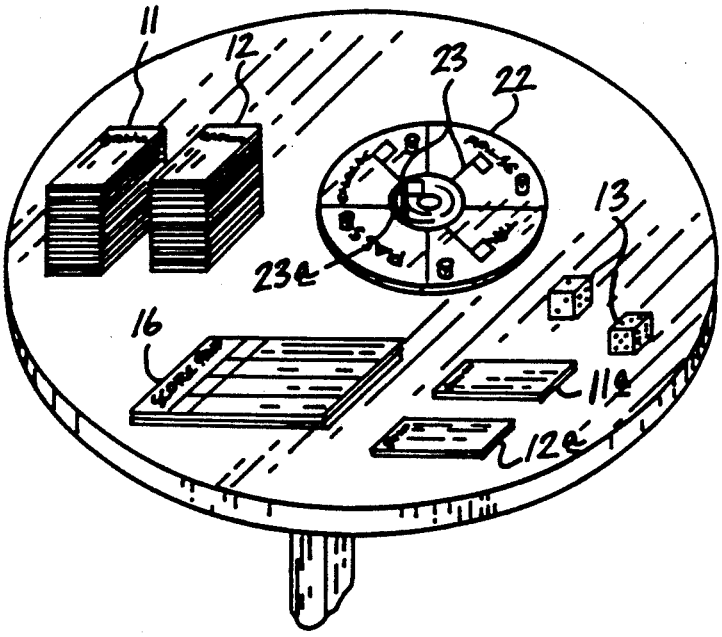
FIG. 7 is an isometric illustration of the instant invention utilizing an optional indicator member associated therewith.

More specifically, the instant invention directed to a game relating to personal relationships 10 essentially includes a stack of question cards 11 defined by at least one hundred such cards, with a like number of category cards defining a stack 12, including four categories, including a first category 17 defining a "true" category, a second category 18 defined by a "false" category, a third category 19 defined by a "pass" category, and a fourth category 20 defined by a "challenge" category. The questions such as card 21, as illustrated in FIG. 3, is typical of inter-personal relationships between couples and is selected by one of a plurality of participants involved in the game. At least four such participants are utilized, and it is determined that an even number of such participants be involved in the game to employ cooperative couples. Initially, a player draws a questions card 21 from the stack of questions 11 and sequentially draws a category card from the stack 12, and the category card will define one of the four categories 17–20, as illustrated in FIG. 2. The drawing player drawing the question and category cards then requests any player the drawing player desires a question and the responding player must respond in consistency with the category chosen, i.e. true, false, the responding player must either pass to another player or challenge the question player. If the responding player answers correctly, the questioning player may then roll the plurality of dice 13 and the indicia so indicated represents a point total for the responding player. The cards drawn from the question and category stacks are then placed in subsequent stacks defining a secondary stack **11*a* and a secondary stack 12*a* defining further stacks for the question and category cards, as illustrated in FIGS. 6 and 7** for example. An adjacent player is then requested to become the next questioning player and is required to subsequently draw a card from each of the stacks, in a manner as noted above.

Examples of questions utilized are as follows:

1. If you and your spouse got a divorce, would everything be divided equally?
2. Your mate likes to flirt at parties.
3. Is your mate the jealous type?
4. Your spouse complains a lot about you.
5. Does your spouse get along well with your relatives or does he/she dislike them?
6. Your spouse likes to spend too much money on unnecessary things?
7. Your mate is more intelligent than you are?
8. Would you say your spouse has good taste when it comes to good music, or he/she would not know good music if he/she heard it?
9. If you got pregnant and you know it is not your husband's baby, would you tell him?
10. Do you and your spouse have the same or similar differences?
11. If your mate was having an affair, would he/she tell you the truth, if you got suspicious?
12. Your mate has a hot temper?
13. Would you support your mate if he/she took ill and was out of work for several weeks?
14. You and your spouse have an open relationship?
15. Your spouse is the know-it-all type?
16. Your boyfriend likes to stare at other women all the time?
17. Your spouse has bad taste in his/her wardrobe?
18. Does your mate make scenes in public or around your friends?
19. You are easily intimidated by your mate?
20. In a relationship, he/she should not have any secrets?

The above twenty questions are merely examples and as noted, at least one hundred such questions defining one hundred such cards in the stack of question cards 11 are utilized, wherein each of the questions are different and are of a typical classification. Scores are inscribed upon the score pad 16 by utilizing a typical writing instrument 15 to keep tabulation of the various scores achieved by each player. As is typical in games, an instruction booklet 4 is included to avoid conflict in interpretation of rules of play.

Further, an optional indicator member 22 is utilized, wherein the first through fourth categories 17–20 are carded in quadrants about the annular indicator member utilizing pivotal flags 23. The indicator member may be utilized by a responding player to visually indicate that player's position in response to the question of a questioning player to visually effect notice of a response by the above noted responding player.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a game relating to personal relationships, comprising the steps of, providing a stack of questions cards, and providing an adjacent stack of category cards, and providing a plurality of dice, and including at least four players, and further including the step of directing a first player of the at least four players to select a question card and a category card, and forming the question cards of the stack of question cards with questions relating to interpersonal relationships between couples, and forming the category cards in the stack of category cards into four categories including a first "true" category, a second "false" category, a third "pass" category, and a fourth "challenge" category, and the first player requesting a second player to respond to a question formed on the drawn question card, and to associate the question card with the drawn category card, and including a further step of a correct response by the second player effecting a rolling of the dice by the first player to indicate a point total, and inscribing the point total upon a score card, and directing a further player of the at least four players to initiate a further cycle including a drawing of a further question from the stack of question cards and a further category card from the stack of category cards.

2. A method as set forth in claim 1 including the step of providing an indicator member, and forming the indicator member as an annular disk, and dividing the annular disk into four quadrants, wherein the four quadrants are divided into the four categories, and providing a pivotal flag mounted adjacent an apex of each of the categories, and including the step of the second player pivoting one of the flags to a vertical orientation from a horizontal orientation to visually effect a choice of one of the four categories in response to the drawn question cards.

* * * * *